US005983905A

United States Patent [19]

Patching

[11] Patent Number: 5,983,905

[45] Date of Patent: Nov. 16, 1999

[54] LIPSTICK CONTAINER CAP WITH FLIP-UP MIRROR

[76] Inventor: Karie Quinn Patching, 4160 Los Coches Way, Sacramento, Calif. 95864

[21] Appl. No.: 09/181,068

[22] Filed: Oct. 27, 1998

Related U.S. Application Data

[60] Provisional application No. 60/063,343, Oct. 28, 1997.

[51] Int. Cl.[6] ..... A45D 42/00

[52] U.S. Cl. ..... 132/318; 132/318

[58] Field of Search ..... 132/318, 316, 132/301, 291

[56] References Cited

U.S. PATENT DOCUMENTS

| | | | |
|---|---|---|---|
| D. 243,124 | 1/1977 | Horowitz . | |
| D. 354,373 | 1/1995 | Khoury . | |
| 1,766,990 | 6/1930 | Freeman . | |
| 2,094,006 | 9/1937 | O'Moore-Farrell . | |
| 2,103,577 | 12/1937 | Farrell | 132/316 |
| 2,143,061 | 1/1939 | Eastley . | |
| 2,254,300 | 9/1941 | Lessin . | |
| 2,512,476 | 6/1950 | Birnkrant et al. | 132/316 |
| 2,771,083 | 11/1956 | Darvie . | |
| 2,951,584 | 9/1960 | Bauer . | |
| 3,123,661 | 3/1964 | Roman . | |
| 4,905,128 | 2/1990 | Caires . | |
| 5,178,478 | 1/1993 | Ryder . | |
| 5,257,696 | 11/1993 | Greene . | |
| 5,441,153 | 8/1995 | Lahaye . | |
| 5,860,755 | 1/1999 | Bunk | 132/316 |

FOREIGN PATENT DOCUMENTS

| | | |
|---|---|---|
| 223436 | 8/1943 | Sweden . |

*Primary Examiner*—Todd E. Manahan
*Attorney, Agent, or Firm*—John P. O'Banion

[57] ABSTRACT

A lipstick container cap with a flip up mirror that can serve as a retrofit for existing lipstick containers and dispensers or form an integral part thereof. At least one reflective surface is provided to aid in the application of lipstick. The cap fits over the lipstick holder and is releasibly attached thereto with a snug fit so that during transport and storage the cap covers and protects the lipstick without risk of disengagement. The end of the cap is fitted with a flip up lid that carries a reflective surface on its inside face. Optionally, the face of the cap beneath the flip up lid is provided with a second reflective surface. The reflective surfaces are typically formed of a convex configuration for visual exaggeration of the facial area to receive the application of lipstick. The flip up lid can be detached from the cap when desired, thereby enabling its use as a separate small makeup mirror that can be held by the user.

12 Claims, 10 Drawing Sheets

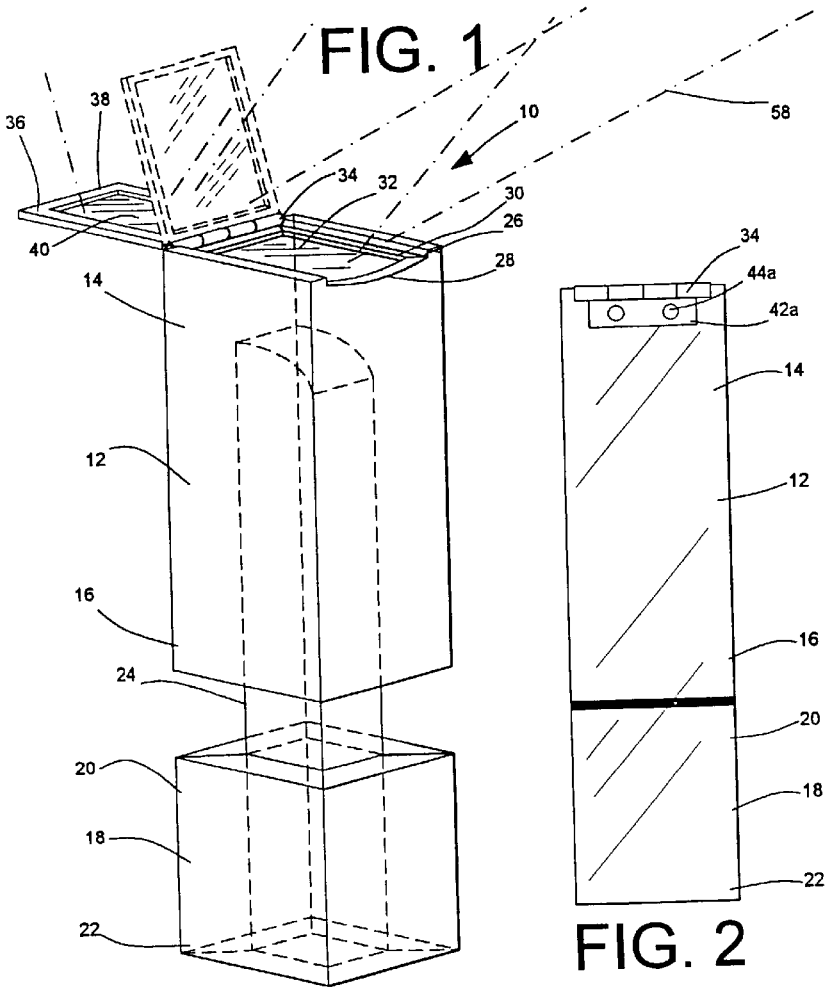
FIG. 1
FIG. 2
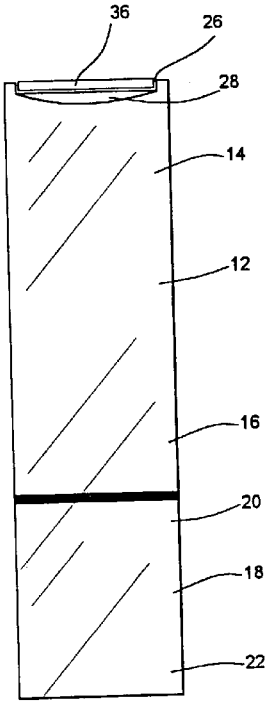
FIG. 3

LIPSTICK CONTAINER CAP WITH FLIP-UP MIRROR

CROSS-REFERENCE TO RELATED APPLICATIONS

This application claims priority from U.S. provisional application Ser. No. 60/063,343 filed on Oct. 28, 1997.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention pertains generally to lipstick containers and dispensers, and more particularly to a lipstick container cap with a flip up mirror that permits visual observation of the facial area when a person is applying lipstick.

2. Description of the Background Art

Wearing lipstick or other similar cosmetics requires that the user have access to a lipstick container and dispenser in a variety of locations, such as at home, work, or other locations away from home in order to apply the lipstick or cosmetic several times during the day to maintain the desired appearance. In most cases, application of the lipstick or cosmetic can be accomplished with relative ease at home or other locations where an adequate-sized mirror is available, such as in the bedroom, bathroom, or powder room. When such mirrors are unavailable, most users resort to using a small makeup mirror that is stored in a purse, handbag, or other like container. These mirrors typically possess the shape and dimensions that allow the user to view with no difficulty the entire facial area, such as lips or cheeks, to receive the lipstick or other makeup. However, the makeup mirror frequently becomes lost, broken, or otherwise unusable so that application of the lipstick becomes difficult or impossible.

Several designs for lipstick containers and dispensers that contain a reflective surface have been developed as a means of overcoming the aforementioned problems with small makeup mirrors. And, efforts are continuously being made in an attempt to develop devices for containing and applying lipstick with the aid of a reflective surface. A significant deficiency with the previously developed solutions, however, is that they do not provide the user with a reflective surface having the ergonomics and features that allow the user to activate and adjust the reflective surface in a variety of locations and circumstances that permit the user to view with ease the specific facial area to receive lipstick or makeup with the minimum number of hand movements and adjustments that may be needed to compensate for the reduced area of the reflective surface. Nor do they provide the user with an integral mirror that can optionally be removed and used as the equivalent of a small makeup mirror in the event that the integral mirror does not provide a suitable viewing position for the user. The present invention satisfies those needs, as well as others, and overcomes the deficiencies in mirrored lipstick containers heretofore developed.

BRIEF SUMMARY OF THE INVENTION

The present invention generally comprises a lipstick container cap with a flip up mirror. It will be appreciated that the invention serve as a retrofit for existing lipstick containers and dispensers or form an integral part thereof. Therefore, in accordance with one aspect of the invention an improved and easier-to-use cap for a lipstick container and dispenser is provided with a reflective surface to aid in the application of lipstick. In accordance with another aspect of the invention, a complete lipstick dispenser and container comprising a body and a cap is provided, the body being configured for containing the lipstick material and the cap functioning as a cover to protect the lipstick during non-use.

By way of example, and not of limitation, a complete lipstick dispenser and container in accordance with the present invention comprises a hollow body and a hollow cap. The body receives and supports a lipstick holder that in turn holds lipstick material that can be either extended or retracted as found in typical lipstick containers, or which is held in a fixed position in relation to the lipstick holder. The body can be manufactured integrally with the lipstick holder, or it can be manufactured without the lipstick holder in which case the lipstick holder and lipstick would be inserted into the body afterward.

The cap fits over the lipstick holder and is releasibly attached thereto with a snug fit so that during transport and storage the cap covers and protects the lipstick without risk of disengagement. The end of the cap is fitted with a flip up lid that carries a reflective surface on its inside face. Optionally, the face of the cap beneath the flip up lid is provided with a second reflective surface. The reflective surfaces are typically formed of a convex configuration for visual exaggeration of the facial area to receive the application of lipstick.

The flip up lid is pivotally attached to cap by means of a hinge. Preferably, the hinge is configured such that the flip up lid can be detached from the cap when desired, thereby enabling its use as a separate small makeup mirror that can be held by the user. A portion of the side wall of the cap opposite the hinge is recessed so that a groove is formed when the lid is closed. The groove provides a space for a finger or fingernail to be inserted for opening the lid when the reflective surface or surfaces are required for application of lipstick.

During use, the cap is removed from the body. The user inserts a finger or fingernail into the aforementioned groove on the cap and opens the lid to the desired angle and, in the case where a second mirror is provided on the end of the cap beneath the lid, also in relation to the second mirror. The ability to adjust the angle in combination with the use of convex mirrors permits a wide-angle view to be achieved by use either a single mirror of the two mirrors in complementary relation. As the viewing requirements change, the lid can be adjusted to varying angles so that the attached reflective surface provides the appropriate view either alone or in conjunction with the second mirror. If necessary, the cap member can be placed on a stationary surface so that a fixed view of the facial area is maintained, and the correct application of makeup is achieved and enhanced. Or, if the viewing position is still insufficient, the flip up lid can optionally be removed from the cap member and held by the user in any desired position.

In accordance with another embodiment of the invention, viewing flexibility is enhanced by provision of an extension arm that is slidably attached to the cap. In this embodiment, the lid is pivotally attached to extension arm in a manner similar to that mentioned previously so that the lid can be opened and adjusted as referenced. The extension arm allows the user to raise the reflective surface of the lid substantially above the plane of the second mirror on the end of the cap, thereby affording the viewer with an extended wide-angle view and viewing opportunities. The user is thus provided with a lipstick container and dispenser that permits the user an infinite number of viewing angles by which to apply lipstick in a variety of locations and circumstances.

Accordingly, an object of the invention is to provide a cap for a lipstick container and dispenser that provides an adjustable mirror.

Another object of the invention is to provide a cap for a lipstick container and dispenser with an adjustable mirror that optionally can be removed and used as a separate make-up mirror.

Another object of the invention is to provide a cap for a lipstick container and dispenser with a plurality of reflective surfaces that provide superior viewing angles for the user.

Another object of the invention is to provide a low-cost, easy-to-manufacture, and easy-to-market lipstick container and dispenser.

Another object of the invention is to provide an easy-to-use and versatile lipstick container and dispenser.

Another object of the invention is to provide a new and improved mirrored lipstick container that is durably and reliably constructed.

Another object of the invention is to provide a lipstick container and dispenser that provides a plurality of reflective surfaces that permit significant variation in viewing the facial area receiving lipstick or makeup.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only:

FIG. 1 is an exploded perspective view of a lipstick container and dispenser in accordance with the invention viewed from the right front.

FIG. 2 is an assembled rear elevation view of the apparatus shown in FIG. 1.

FIG. 3 is an assembled front elevation view of the apparatus shown in FIG. 1.

DETAILED DESCRIPTION OF THE INVENTION

Figure 4:
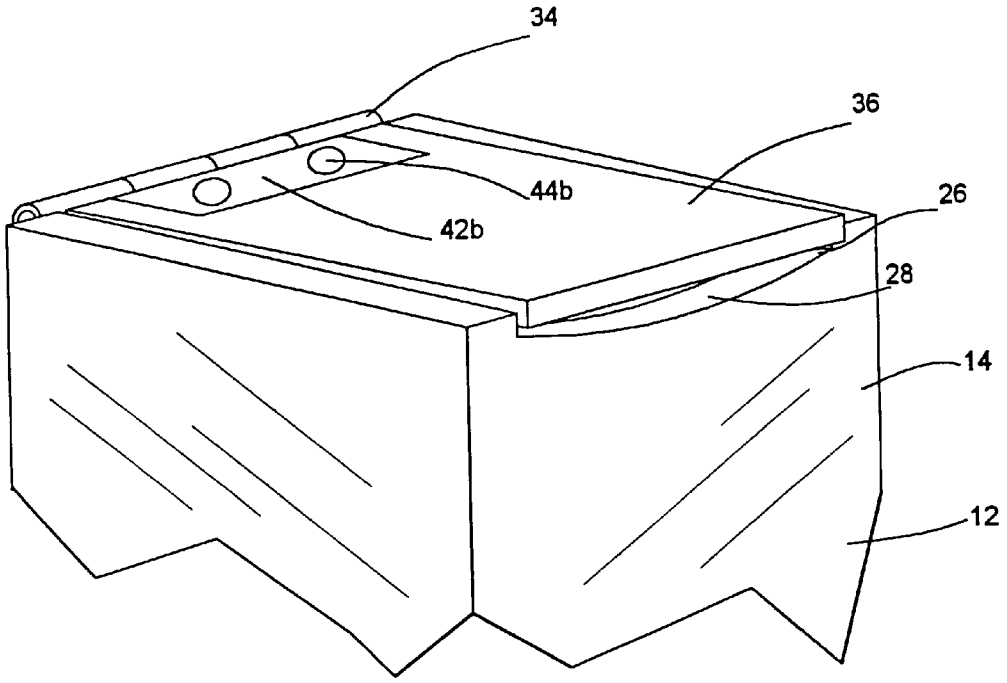
FIG. 4 is a partial enlarged perspective view of the cap portion of the apparatus shown in FIG. 1 viewed from the right front.

Referring more specifically to the drawings, for illustrative purposes the present invention is embodied in the apparatus generally shown in FIG. 1 through FIG. 11, where like reference numbers denote like parts. It will be appreciated that the apparatus may vary as to configuration and as to details of the parts without departing from the basic concepts as disclosed herein.

Referring first to FIG. 1 through FIG. 4, a typical embodiment of a complete lipstick container and dispenser 10 in accordance with the invention is shown comprising a hollow tubular cap 12 having an upper portion 14 and a lower portion 16, and a hollow tubular body 18 having an upper portion 20 and a lower portion 22. Body 18 accommodates a lipstick holder 24, which can be manufactured integrally with body 18 or which can be inserted and fixedly or releasibly attached thereafter. If lipstick holder 24 is releasibly attached to body 18, the user is afforded the opportunity to use different textures and colors of lipstick over the life of the apparatus. Furthermore, lipstick holder 24 can be configured to hold lipstick material in a fixed position or it can be configures to allow the lipstick material to be extended and retracted as is commonly found in conventional lipstick containers and dispensers.

As shown in FIG. 1, the lower portion 16 of cap 12 slidably fits over lipstick holder 24 so that a snug fit is achieved for transport and storage. Alternatively, it will be appreciated that cap 12 and body 18 could be configured to releasibly mate in any conventional manner using, for example, tongue and groove, snap bosses, clips and like mating mechanisms. At the upper portion 14 of the cap 12, an end cover 30 having a reflective surface 32 is provided. Reflective surface 32 covers at least a portion of end cover 30. In addition, a flip up lid 36 comprising a frame 38 and a reflective surface 40 is pivotally attached to the end of cap 12 by a pin-type hinge 34 or the like. Lid 36 provides the user with access to an inner reflective surface 40. Note that reflective surface 32, 40 complement each other to provide a superior field of view than prior lipstick container and dispenser devices. However, reflective surface 32 is optional. Note also that reflective surfaces 32, 40 can be formed in many ways, including, but not limited to, by attachment of unitary mirrors or use of reflective materials and the like. For example, reflective surfaces can be formed from styrene, PETG, glass, acrylic and the like.

A curved edge 28 is provided on the side of cap member 12 opposite to the side of attachment of hinge 34. The curved edge 28 opens to a recess 26 formed by the lower plane of the surface of end cover 30 in relation to a majority of the sidewalls of the cap. This recess allows lid 36 to close and achieve a closed position that is flush or substantially flush with the upper member as illustrated in detail in FIG. 3 and FIG. 4. Furthermore when the lid is closed, curved edge 28 of the sidewall forms a grooved space between lid 36 and curved edge 28 so that the user can place the tip of a finger or a fingernail in said space to facilitate opening of lid 36.

The complementary relation of the reflective surfaces 32, 40 allows the reflective surfaces to augment the viewing area, thereby permitting the user a wide variety of viewing angles 58 that can accommodate the changing nature of makeup application. This flexibility is enhanced with the hinged attachment of the mirrored lid 36, which permits said lid to be adjusted as needed, as illustrated.

Referring more particularly to FIG. 2 and FIG. 3, the apparatus is illustrated in the closed, or store and carry, configuration. In FIG. 2, the details of an attachment flange 42*a* of hinge member 34 and a fastening member 44*a* can be seen. FIG. 3 illustrates the opposite side of the lipstick container and dispenser shown in FIG. 2 with the edge of lid 36 displayed in proximate relation to curved edge 28 of sidewall thus forming the groove space for inserting a finger or fingernail and opening the lid. FIG. 4 illustrates in detail the lid 36 in the closed position and the groove space thus formed between lid 36 and curved edge 28 of the sidewall along with attachment flange 42*b* and fastening member 44*b* of hinge member 34. It will be seen, therefore, that lid 36 is moveable between a closed position and plurality of open positions, where lid 36 and reflective surface 40 cover at least a portion of end cover 30 when lid 36 is in the closed position.

Figure 5:
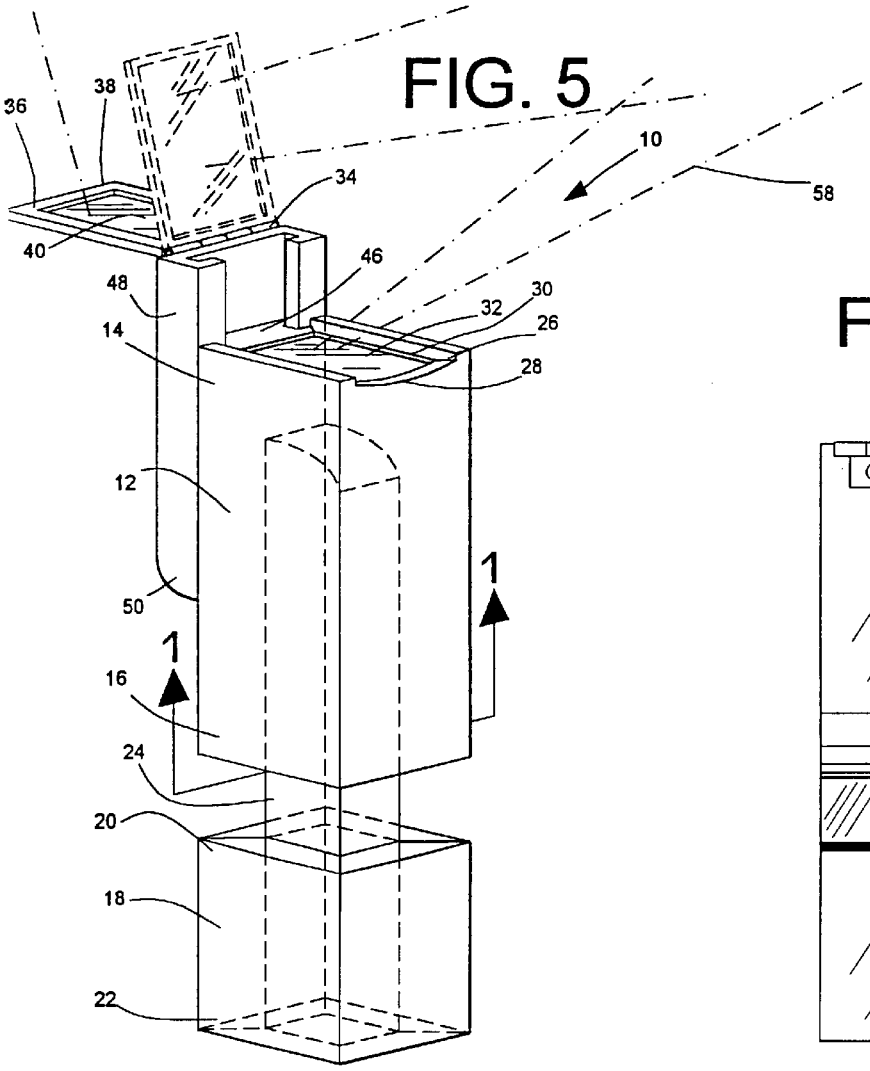
FIG. 5 is an exploded perspective view of an alternative embodiment of a lipstick container and dispenser in accordance with the present invention, viewed from the right front.
Figure 6:
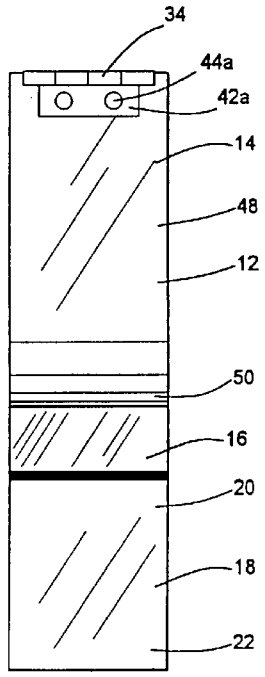
FIG. 6 is an assembled rear elevation view of the apparatus shown in FIG. 5.
Figure 7:
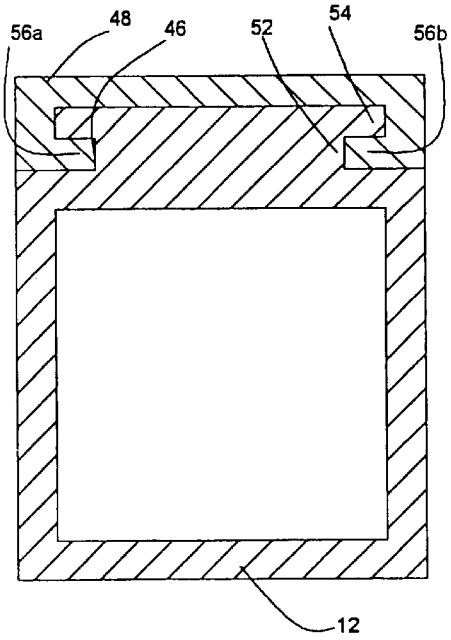
FIG. 7 is a cross-sectional view of the cap member portion of the apparatus shown in FIG. 6 taken through line 6—6.

Referring now to FIG. 5 through FIG. 7, an alternative embodiment of a lipstick container and dispenser in accordance with the invention is shown. This embodiment provides an extension member 48 that is slidably attached to a guide member 46 that is formed integral with cap 12 on the sidewall opposite to the sidewall containing curved edge 28. Extension member 48 is provided with a rounded lower portion 50 that facilitates adjustment of the extension member. At the end of the extension member distal from rounded portion 50, hinge member 34 attaches said extension member to lid 36. The extension member operates coplanar to the longitudinal axis of the upper member and permits reflective surface 40 of lid 36 to be extended at a height that varies above the plane of the complementary reflective surface 32.

Extension member 48 is illustrated in FIG. 6 in the closed or retracted position, revealing the relationship of extension member 48 and rounded portion 50 of cap 12 and body member 18. In FIG. 7, the cross sections of cap 12 and extension member 48 are revealed along lines 7—7 of FIG. 5 to show the details of attachment. Extension member 48 is slidably attached to guide member 46 that is formed integrally with cap 12. Extension member 48 is provided with enfolding portions 56*a*, 56*b* that are frictionally engaged in confronting relationship with a shank portion 52 and cross portion 54 of guide member 46 so that the extension member can be slidably positioned with minimal effort and retain the desired position until further adjustment. The wider range of viewing angles that extension member 48 permits between reflective surfaces 32, 40 enhances the wide-angle view 58 that the complementary surfaces already provide and permits lipstick to be applied easily and efficiently.

Figure 8:
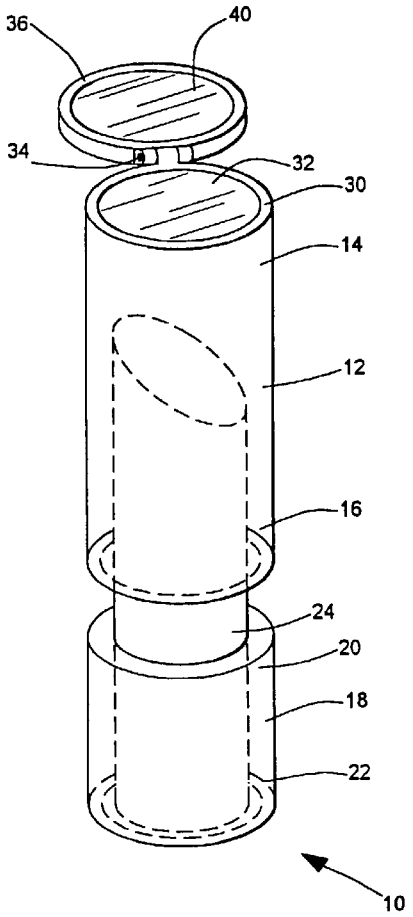
FIG. 8 is an exploded perspective view of a third alternative embodiment of the invention viewed from the right front.
Figure 9:
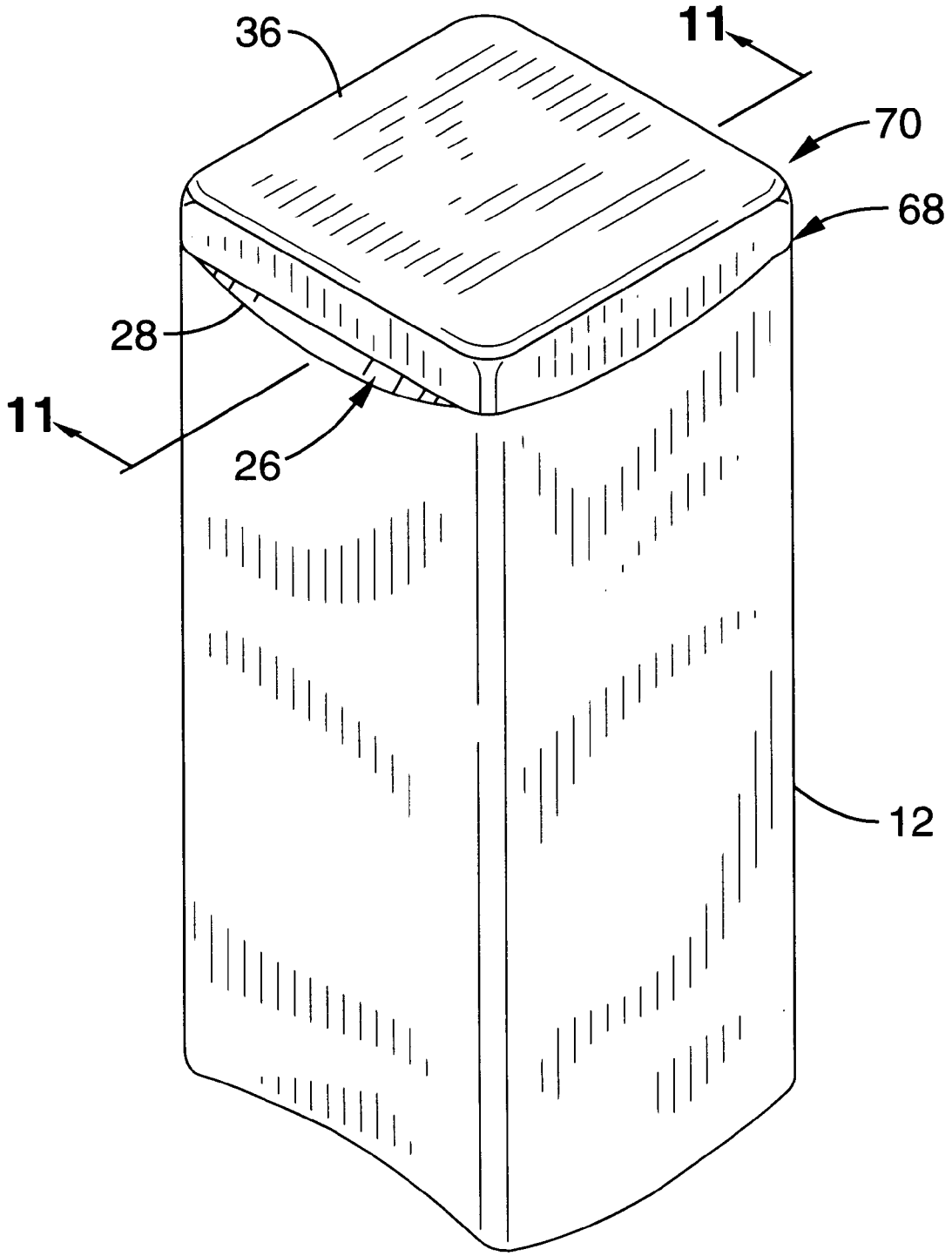
FIG. 9 is a perspective view of an alternative embodiment of the cap assembly portion of a lipstick container and dispenser in accordance with the present invention with a detachable mirrored lid, viewed from the left front and shown the lid in the closed position.
Figure 10:
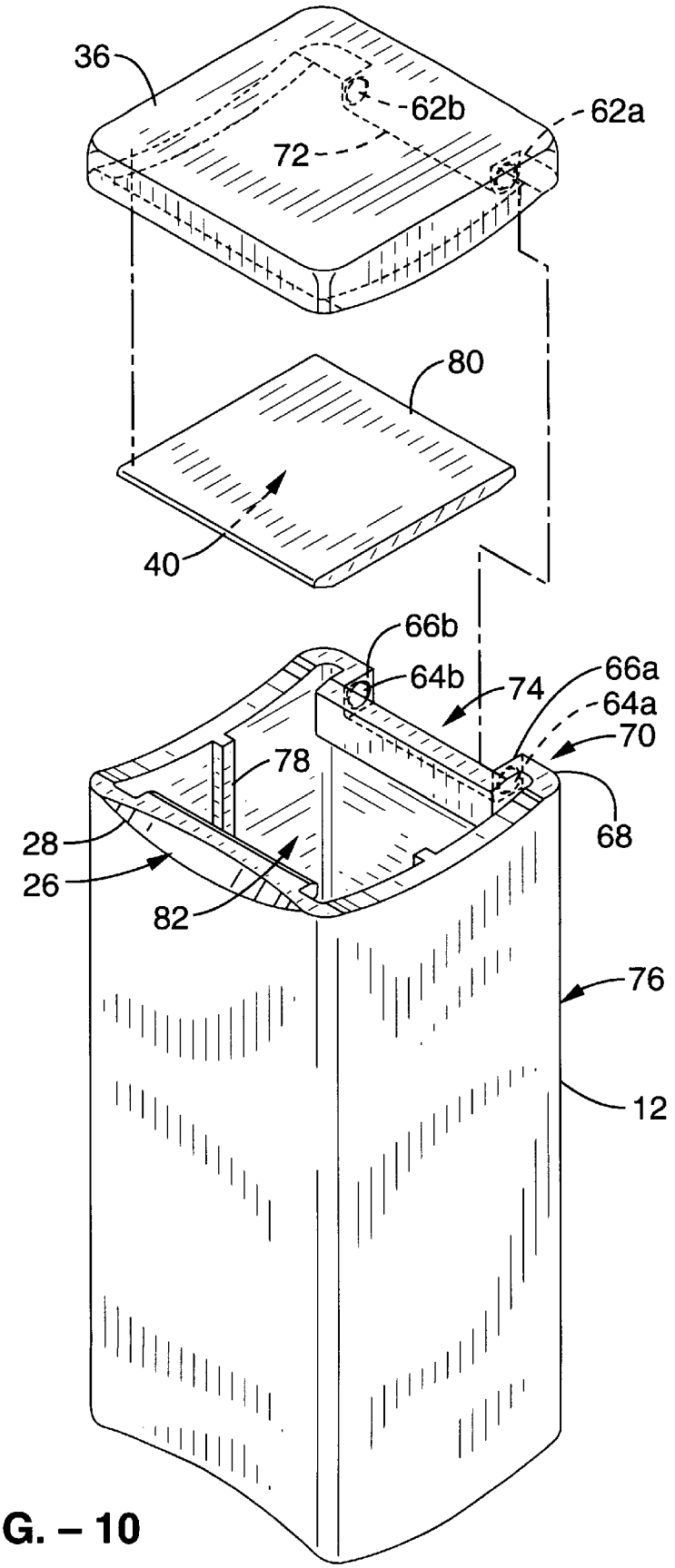
FIG. 10 is an exploded view of the cap assembly shown in FIG. 9.
Figure 11:
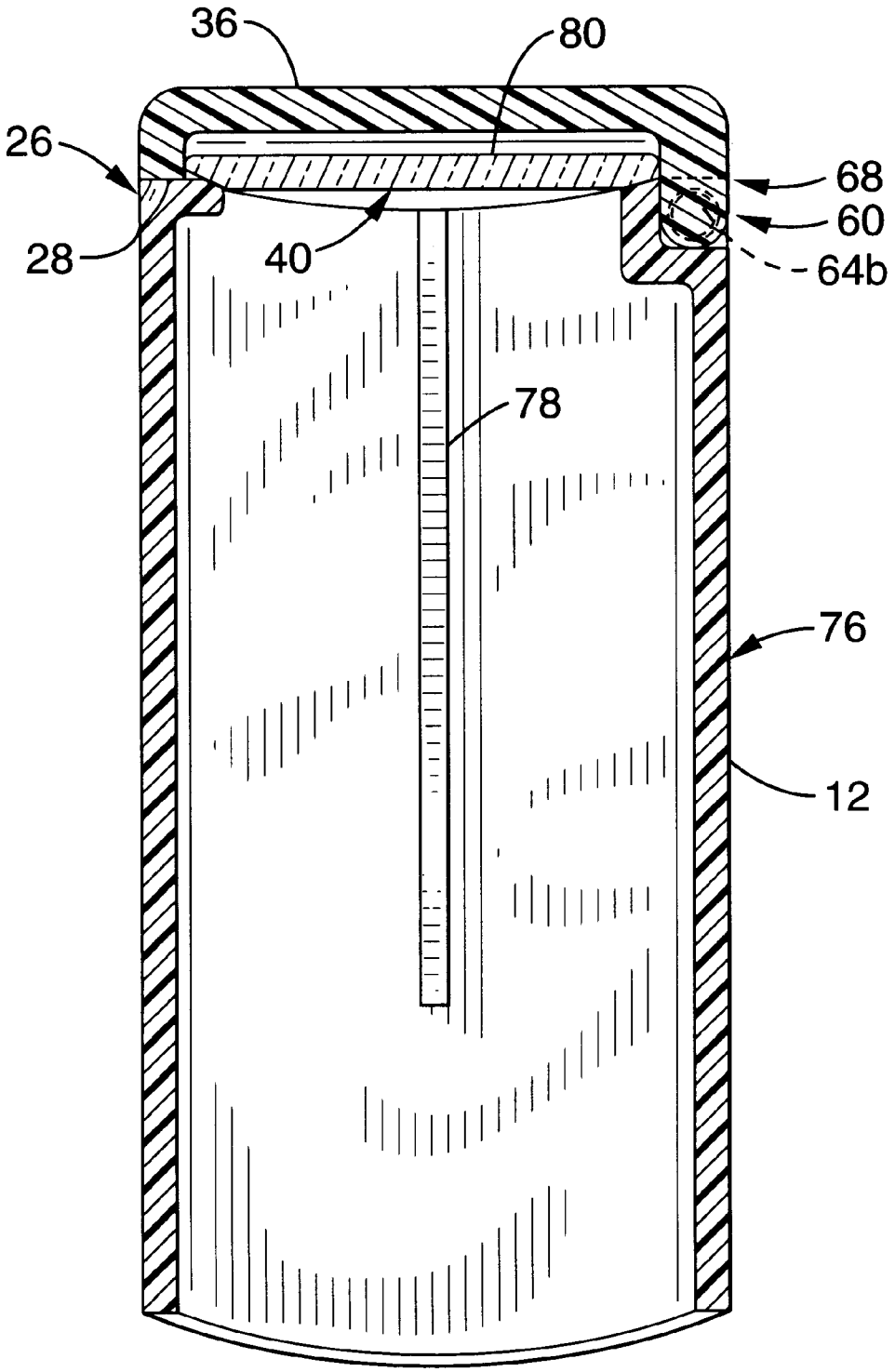
FIG. 11 is a cross-sectional view of the cap assembly shown in FIG. 9 taken through lines 11—11.
Figure 12:
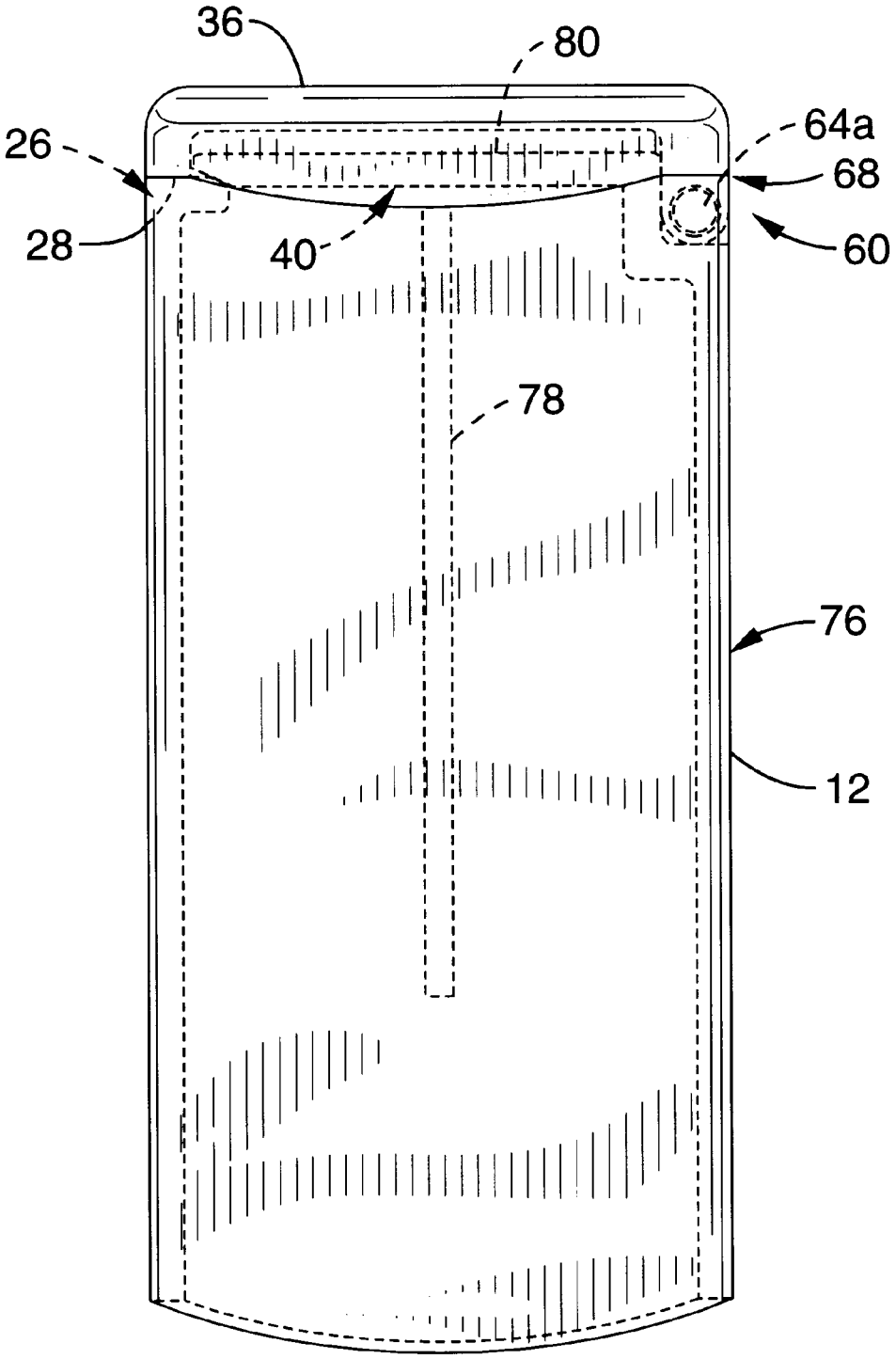
FIG. 12 is a left side elevation view of the cap assembly shown in FIG. 9.
Figure 13:
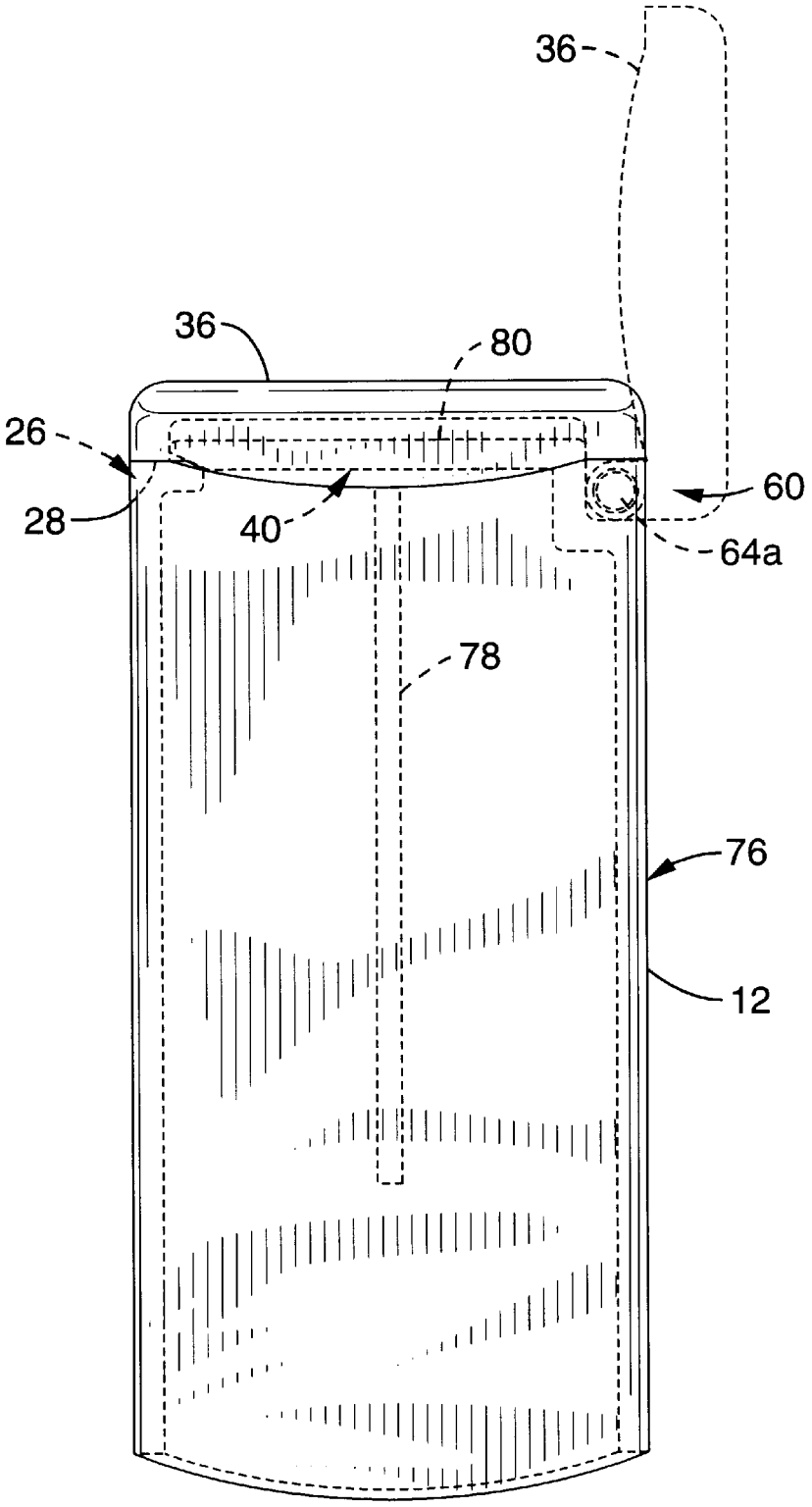
FIG. 13 is a left side elevation view of the cap assembly shown in FIG. 9 diagrammatically showing the lid in closed and fully opened positions.
Figure 14:
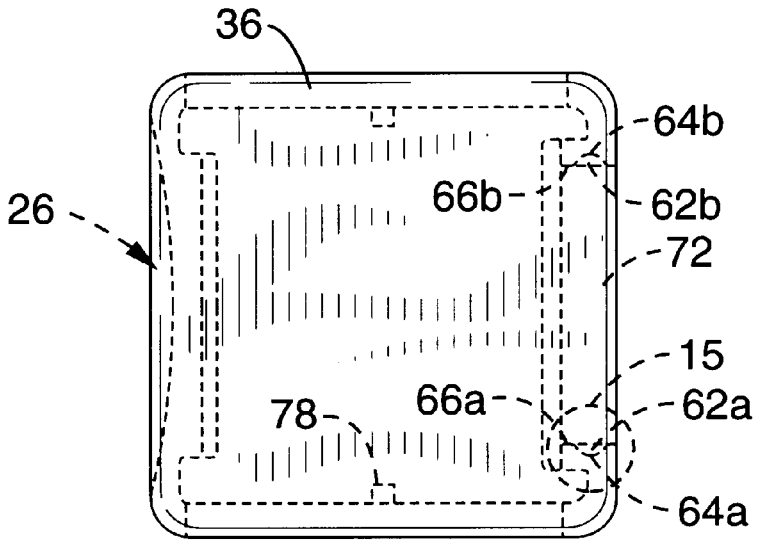
FIG. 14 is a top plan view of the cap assembly shown in FIG. 9.
Figure 15:
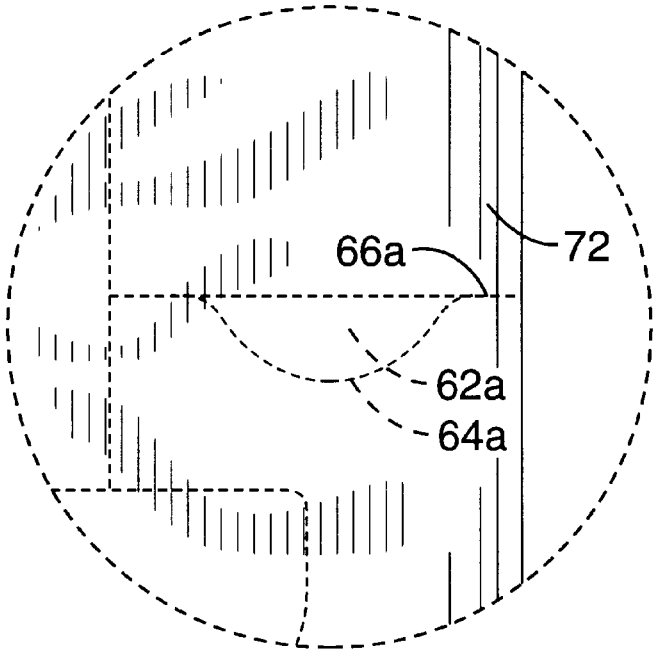
FIG. 15 is a fragmentary detail view of a portion of the hinge assembly shown in FIG. 14.

Referring now to FIG. 8, a third alternative embodiment of a lipstick container and dispenser in accordance with the invention is shown comprising a cap 12, body 18, and lipstick holder 24 that are circular-shaped in cross section. The operation of the apparatus is identical to that described previously in connection with the embodiment shown in FIG. 1 through FIG. 4.

Referring now to FIG. 9 through FIG. 15, an alternative embodiment of cap 12 is shown. In this embodiment, lid 36 is detachable from cap 12 to provide the user with the option of using lid 36 and its interior reflective surface 40 as a separate makeup type mirror. This provides the user with additional flexibility of view angles not otherwise provided with a non-detachable lid and, in addition, provides the user with a mirror that can be used for other purposes, such as inspection of other portions of the face, signaling, and nearly any other application requiring use of a mirror.

The principal difference between lid 36 in this embodiment and the lid shown in the prior embodiments rests in hinge assembly 60, the preferred embodiment of which can be seen in FIG. 10 through FIG. 15. Instead of using a pin-type hinge 34 as previously shown, hinge assembly 60 employs protruding semi-spherical tabs 62*a*, 62*b* on lid 36 that fit into complementary semi-spherical receptacles 64*a*, 64*b* on cap 12. It will be appreciated that the positional relationship of the tabs and receptacles could be altered. For example, lid 36 could carry the receptacles and cap 12 carry the tabs. Alternatively, lid 36 could carry one tab and one receptacle with cap 12 carrying a mating receptacle and tab, respectively.

As indicated previously, hinge assembly 60 is configured so that lid 36 can be removed from cap 12. This is facilitated by using a resilient material for tabs 62*a*, 62*b* that can be compressed or deformed for insertion into, or removal from, receptacles 64*a*, 64*b*. Lid 36 and tabs 62*a*, 62*b* can be molded from conventional synthetic materials than can be used for this purpose. Other materials can be used provided that tabs 62*a*, 62*b* are sufficiently resilient to permit removal and attachment of lid 36 without breaking. Alternatively, tabs 62*a*, 62*b* can be rigid, in which case sidewalls 66*a*, 66*b* that carry receptacles 64*a*, 64*b* should be sufficiently flexible that they can be spread apart slightly during attachment or removal of lid 36. In either case, it will be appreciated that the tolerance between the tabs and receptacles must be such that lid 36 does not detach when flipped up during use while, at the same time, permitting lid 36 to be removed without significant effort when desired. It will further be appreciated that the tabs and receptacles could have other shapes, such as short cylindrical pins and complementary cylindrical bores, although the semi-spherical shape is preferred for smooth pivotal motion while still providing for easy removal and attachment of lid 36.

As shown, hinge assembly 60 is positioned adjacent an edge 68 of distal end 70 of cap 12. An advantage of this configuration is that hinge body 72 fits into a cutout 74 in cap 12 and is recessed in relation to the side 76 of cap 12 when lid 36 is in the closed position. This provides a hinge assembly that is less bulky and more aesthetically pleasing than hinge 34 shown previously. Those skilled in the art will appreciate that this is merely an example of a recessed hinge assembly and that other configurations could be used.

Note that ribs 78 are provided to facilitate frictional engagement with lipstick holder 24 (not shown). Note also that, in the embodiment shown, reflective surface 40 is provided by means of a mirror 80 which is attached to the interior surface of lid 36 using adhesives or any conventional fastening means. Alternatively, a reflective surface can simply be provided in any conventional manner such as those previously described herein.

For simplicity, the drawings do not show an end cover 30 or a second reflective surface 32 described in connection with the previous embodiments. It will be appreciated, however, a second mirror could easily be placed over the void 82 in cap 12 shown, or and end cover with a reflective surface provided therein. Furthermore, it will be appreciated that even if a second reflective surface is not provided, void 82 could remain or cap 12 could be closed off with an end cover similar to that previously described.

It will further be appreciated that the invention could be embodied in a version having a removable mirror on the side of the cap or body.

Those skilled in the art will appreciate that the invention described herein can be modified and changed in various ways without departing from the scope of the invention. The cross-sectional shapes of the body and cap, as well as the lipstick holder, can be square, circular, triangular, hexagonal, or any other desired shape without departing from the invention. The body, cap and lipstick holder can be manufactured of plastic, wood, semi-precious material or the like. It will be appreciated that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. While the invention has been described herein with many specificities, it is not desired to limit the invention to the exact construction and operation shown and described, and accordingly all suitable modifications and equivalents may be resorted to, falling within the scope of the invention. Furthermore, while this invention has been described in its preferred forms with a certain degree of particularity, it is understood that the present disclosure of the preferred forms has been made only by way of example and numerous changes in the details of construction and combination and arrangement of parts may be resorted to without departing from the spirit and scope of the invention. Accordingly, the scope of this invention should be determined by the appended claims and their legal equivalents.

What is claimed is:

1. A lipstick container cap assembly, comprising:

(a) a hollow cap having a first end and a second end; and (b) a lid detachably coupled to said first end of said cap by a snap-connector hinge assembly;

(c) wherein said lid is moveable between a closed position and a plurality of open positions, and wherein said lid has an inner reflective surface covering at least a portion of said first end of said cap when said lid is in said closed position and wherein said lid can be snapped on and off of said cap.

2. A lipstick container cap assembly as recited in claim 1, further comprising a second reflective surface covering at least a portion of said first end of said cap.

3. A lipstick container cap assembly as recited in claim 1, further comprising means for engaging a lipstick holder.

4. A lipstick container cap assembly as recited in claim 1, wherein said snap-connector hinge assembly comprises:

(a) a hinge body extending from said lid, said hinge body having a plurality of tabs; and (b) a plurality of receptacles disposed in said cap, said receptacles receiving said tabs.

5. A lipstick container cap assembly, comprising:

(a) a hollow cap having a first end and a second end;

(b) a lid;

(c) a hinge body extending from said lid, said hinge body having a plurality of tabs; and (d) a plurality of receptacles disposed in said cap, said receptacles receiving said tabs;

(e) wherein said tabs and said receptacles form a snap-connector hinge assembly wherein said lid can be snapped on and off of said cap, wherein said lid is moveable between a closed position and a plurality of open positions, and wherein said lid has an inner reflective surface covering at least a portion of said first end of said cap when said lid is in said closed position.

6. A lipstick container cap assembly as recited in claim 5, further comprising a second reflective surface covering at least a portion of said first end of said cap.

7. A lipstick container cap assembly as recited in claim 5, further comprising means for engaging a lipstick holder.

8. A lipstick container cap assembly, comprising:

(a) a hollow cap having a first end and a second end;

(b) an extension member slidably coupled to said cap; and (c) a lid pivotally coupled to said extension member;

(d) wherein said extension member is moveable between a retracted position and a plurality of extended positions, wherein said lid is moveable between a closed position and a plurality of open positions, and wherein said lid has an inner reflective surface covering at least a portion of said first end of said cap when said lid is in said closed position and said extension member is in said retracted position.

9. A lipstick container cap assembly as recited in claim 8, further comprising a second reflective surface covering at least a portion of said first end of said cap.

10. A lipstick container cap assembly as recited in claim 8, wherein said lid is detachably coupled to said extension member.

11. A lipstick container cap assembly as recited in claim 8, further comprising means for engaging a lipstick holder.

12. A lipstick container cap assembly, comprising:

(a) a hollow cap having a first end and a second end;

(b) an extension member slidably coupled to said cap; and (c) a lid pivotally coupled to said extension member;

(d) wherein said lid is moveable between a closed position and a plurality of open positions, and wherein said lid has an inner reflective surface covering at least a portion of said first end of said cap when said lid is in said closed position.

* * * * *